US009434185B2

(12) United States Patent
Schmidt

(10) Patent No.: US 9,434,185 B2
(45) Date of Patent: Sep. 6, 2016

(54) DEVICE FOR PRINTING ON TWO SIDES

(71) Applicant: HEIDELBERGER DRUCKMASCHINEN AG, Heidelberg (DE)

(72) Inventor: Thomas Schmidt, Heidelberg (DE)

(73) Assignee: Heidelberger Druckmaschinen AG, Heidleberg (DE)

( * ) Notice: Subject to any disclaimer, the term of this patent is extended or adjusted under 35 U.S.C. 154(b) by 3 days.

(21) Appl. No.: 14/794,877

(22) Filed: Jul. 9, 2015

(65) Prior Publication Data

US 2016/0023478 A1 Jan. 28, 2016

(30) Foreign Application Priority Data

Jul. 24, 2014 (DE) ..... 10 2014 010 905

(51) Int. Cl.

| | |
|---|---|
| ***B41J 3/60*** | (2006.01) |
| ***B41J 11/00*** | (2006.01) |
| ***B41J 11/04*** | (2006.01) |
| ***B41J 2/01*** | (2006.01) |

(52) U.S. Cl.

CPC ..... *B41J 11/007* (2013.01); *B41J 2/01* (2013.01); *B41J 3/60* (2013.01); *B41J 11/04* (2013.01); *B41J 2002/012* (2013.01)

(58) Field of Classification Search

CPC ..... G03G 2215/0106; G03G 15/231; B41J 3/60

USPC ..... 347/103, 104; 399/302, 309, 298; 428/32.12, 32.26

See application file for complete search history.

(56) References Cited

U.S. PATENT DOCUMENTS

| | | | | |
|---|---|---|---|---|
| 3,166,012 | A * | 1/1965 | Hantscho | B41F 7/12 101/220 |
| 8,287,117 | B2 | 10/2012 | Ageishi | |
| 2001/0021331 | A1* | 9/2001 | Brewington | B41J 3/60 400/188 |
| 2007/0097173 | A1* | 5/2007 | Hubler | B41J 2/16505 347/33 |
| 2013/0312626 | A1* | 11/2013 | Kamoda | B41F 7/06 101/216 |

FOREIGN PATENT DOCUMENTS

| | | | |
|---|---|---|---|
| DE | 102006036026 | A1 | 3/2007 |
| DE | 102009000518 | A1 | 8/2010 |
| WO | 2010086204 | A1 | 8/2010 |

* cited by examiner

*Primary Examiner* — Julian Huffman
*Assistant Examiner* — Sharon A Polk
(74) *Attorney, Agent, or Firm* — Laurence A. Greenberg; Werner H. Stemer; Ralph E. Locher

(57) ABSTRACT

A device for printing on both sides of sheet-shaped printing substrates uses a pivotable ink application unit. An ink transfer unit is disposed to pivot between two impression cylinders that succeed each other and is thus capable of printing the first side and the second side of the same sheet.

11 Claims, 6 Drawing Sheets

DEVICE FOR PRINTING ON TWO SIDES

CROSS-REFERENCE TO RELATED APPLICATION

This application claims the priority, under 35 U.S.C. §119, of German application DE 10 2014 010 905.4, filed Jul. 24, 2014; the prior application is herewith incorporated by reference in its entirety.

BACKGROUND OF THE INVENTION

Field of the Invention

The present invention relates to a device for printing on two sides of sheet-shaped printing substrates.

It is known to print on two sides of sheet-shaped printing substrates. The desired outcome of a sheet that has been printed on both sides is attained for instance by passing the sheet through the press once to print a complete image on the first or front side of the sheet in one run. Subsequently, the sheet is manually or automatically turned or reversed outside the press and re-fed to the press to receive a printed image on the second or back side. Due to the reversing of the sheet, difficulties may arise with respect to feeding the sheets to the press so that they are in register. Moreover, the reversing of the sheets and the refeeding of the sheets to the printing device are two additional process steps. Other solutions propose to print on two sides of the sheets without any external reversing of the sheets. However, these solutions require additional printing units to be provided in the press especially for printing on the second or second side of the sheets and an internal reversing device, resulting in additional costs.

Published, non-prosecuted German patent application DE 10 2006 036 026 A1 discloses a pivotable process unit. The process unit has various modes of operation. In a first mode of operation, for instance, the process unit may image a printing form, and, in a second mode of operation, the process unit may alternatively dry the printing substrate. For this purpose, it may be pivoted back and forth between the printing form and the printing substrate to be dried.

U.S. Pat. No. 8,287,117 B2 discloses an indirect printing process using a transfer belt. A print head prints on the transfer belt. The transfer belt is guided by rollers and subsequently prints on the printing substrate.

SUMMARY OF THE INVENTION

An object of the present invention is to provide an improved device for printing on both sides of sheet-shaped printing substrates at minimum costs.

The device of the invention for printing on two sides of sheet-shaped printing substrates is used in duplex printing machines. A sheet-shaped printing substrate is received by a first impression cylinder and printed on a first or front side by a pivotable ink application unit. Then the printing substrate is transferred from the first impression cylinder to an adjacent second impression cylinder in such a way that on the second cylinder, the second or back side of the printing substrate faces outward. The ink application unit is pivoted in the direction of the second impression cylinder. On the second impression cylinder, the second side is now printed by the ink application unit.

In accordance with a first embodiment of the machine, provision is made for the pivotable ink application unit to be a pivotable inkjet print head.

In accordance with a further development of this embodiment, provision is made for the pivoting movement of the inkjet print head to be limited by end stops.

In accordance with another further development of this embodiment, provision is made for the end stops to be provided with dampers suitable for reducing the speed of impact of the inkjet print head on the end stops.

In accordance with a second embodiment of the device, provision is made for the pivotable ink application unit to be a transfer belt disposed above the impression cylinder and guided by at least three rollers, the two upper ones of which are stationary. At least one lower roller is movable. The printed image may be applied to the belt by an inkjet print head.

In accordance with a further development of this embodiment of the invention, provision is made for at least two movable lower rollers to be provided in addition to the two upper stationary rollers, the at least two lower rollers are movable by a parallelogram guide.

In accordance with a further embodiment, provision is made for the pivotable ink application unit to consist of a print head, an imaging cylinder, a first transfer cylinder, and a second transfer cylinder. The print head prints on the imaging cylinder. The imaging cylinder transfers the first-side image to a first transfer cylinder. The first transfer cylinder prints the first-side image onto the first side of the sheet while the imaging cylinder applies the second-side image to the second transfer cylinder. The second transfer cylinder is configured to be pivotable between the imaging cylinder and the second impression cylinder. The second transfer cylinder transfers the second-side image to the second side of the sheet.

In accordance with a further development of this embodiment, provision is made for the second transfer cylinder to include a drive capable of changing its direction of rotation.

In accordance with a further embodiment of the invention, provision is made for the sheet-shaped printing substrate to be guided through more than 360° on the second impression cylinder.

Other features which are considered as characteristic for the invention are set forth in the appended claims.

Although the invention is illustrated and described herein as embodied in a method for printing on two sides, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
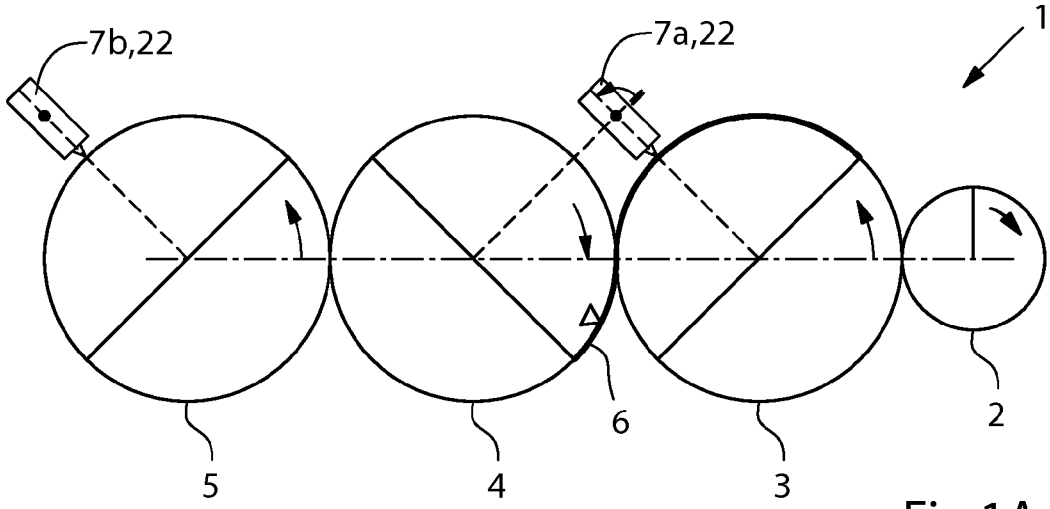
FIGS. 1A to 1C are diagrammatic side views of sections of a first embodiment of a printing press according to the invention.

Referring now to the figures of the drawings in detail and first, particularly to FIG. 1A thereof, there is shown a section of a printing press 1. The section consists of a feed cylinder 2 and at least three impression cylinders 3, 4, 5. The second impression cylinder 4 is a cylinder that guides the sheets through more than 360°. The section further includes two print heads 7*a*, 7*b* embodied as inkjet print heads. A first inkjet print head 7*a* may be pivoted between the first impression cylinder 3 and the second impression cylinder 4. Furthermore a sheet 6 is shown as it passes through the printing process. On the first impression cylinder 3, the first side of the sheet 6 is printed by the first inkjet head 7*a* and then the sheet 6 is transferred to the second impression cylinder 4. On the second impression cylinder 4, the printed first side of the sheet 6 faces inward.

Figure 1B:
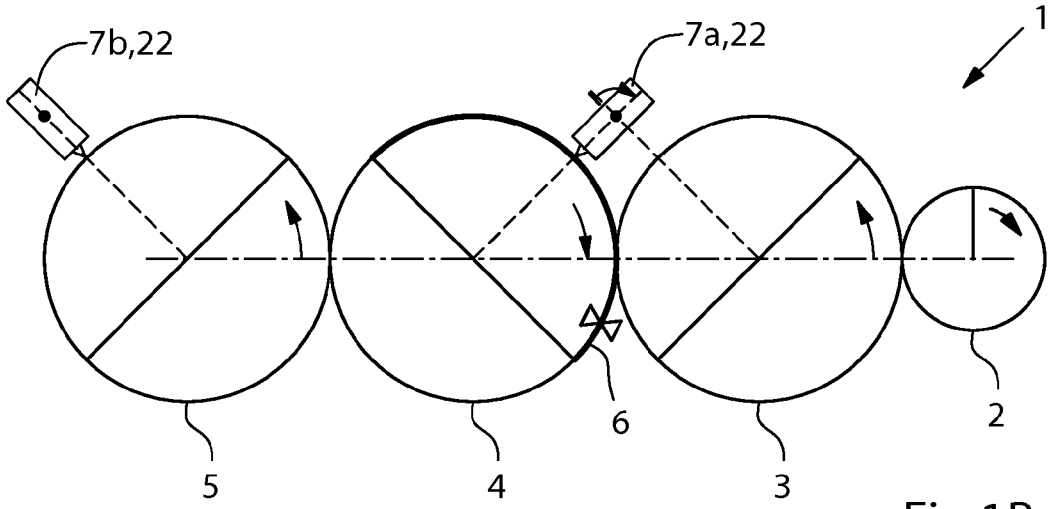

FIG. 1B illustrates the same section of the printing press 1 described FIG. 1A. In FIG. 1B, the second impression cylinder 4 carrying the sheet 6 has already carried out a revolution through more than 360°. The first inkjet head 7*a* has been pivoted in the direction of the second impression cylinder 4 to print on the second side of the sheet 6.

Figure 1C:
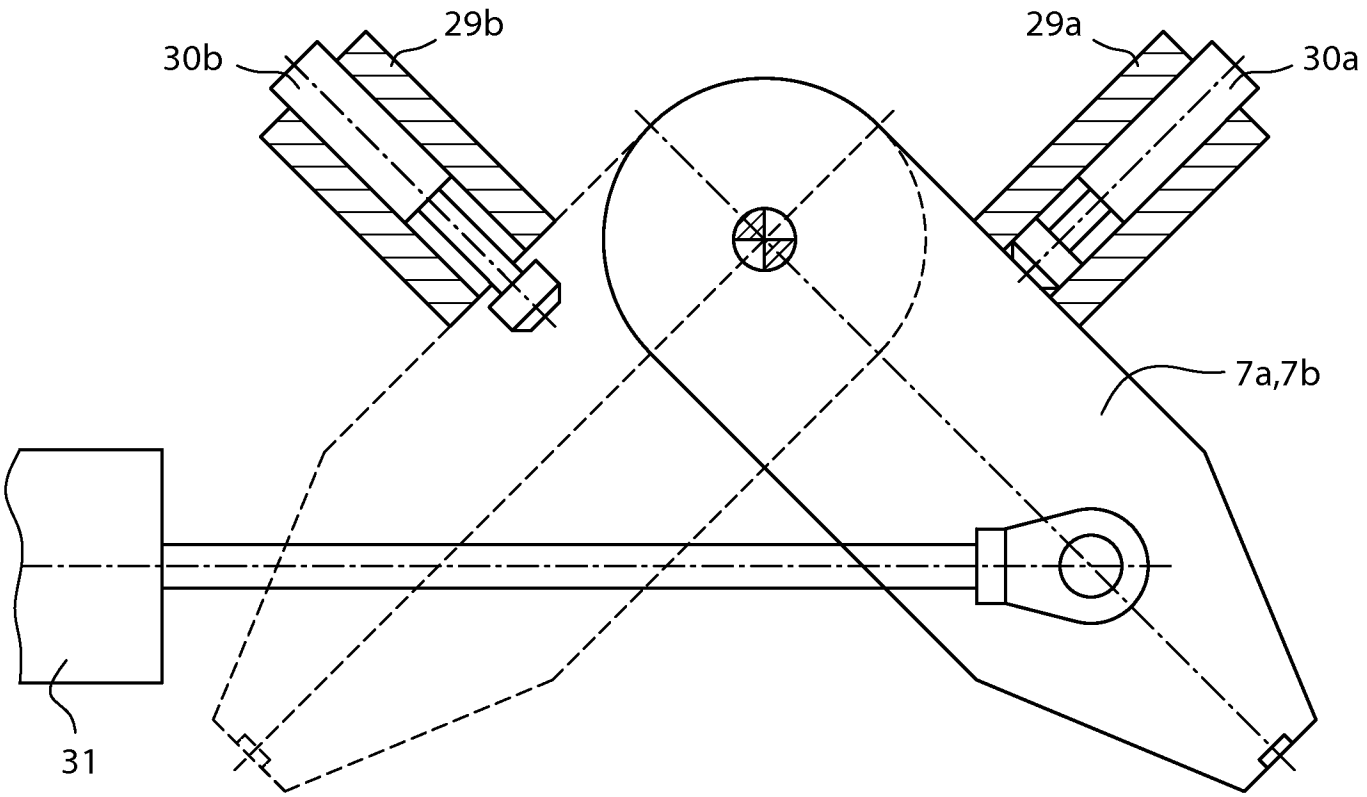

FIG. 1C illustrates a section of the arrangement described in FIG. 1A. The first inkjet print head 7*a* is shown in a position to print on a first side. In this position, the first inkjet print head 7*a* rests against an end position stop 29*a* for printing on the first side. The end position damper 30*a* is pressed into the end position stop 29*a* by the inkjet print head 7*a*. An end position stop 29*b* for the end position for printing on the second side is shown on the opposite side. The corresponding end position damper 30*b* is extended. A pneumatic pivoting device 31 for implementing the pivoting movement of the inkjet print head 7*a* is also provided.

Figure 2A:
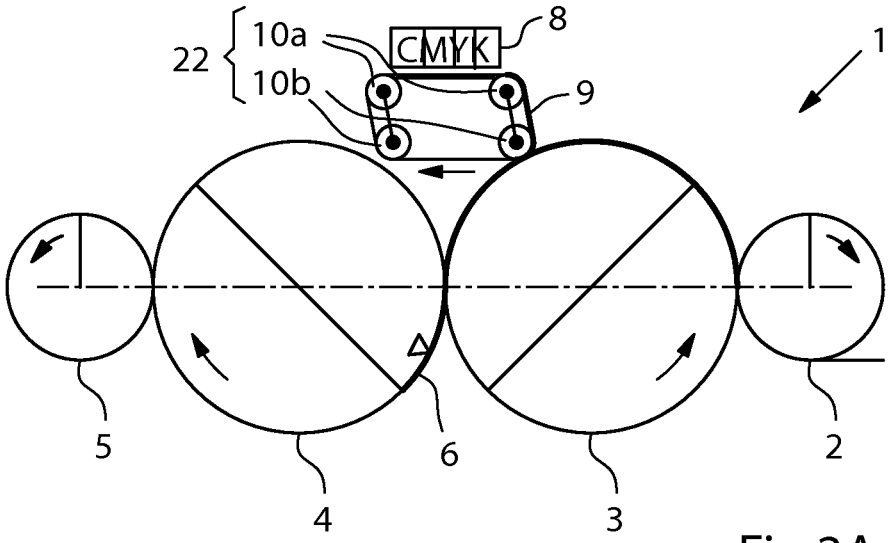
FIGS. 2A to 2C are diagrammatic side views of sections of a second embodiment of the printing press.

FIG. 2A illustrates a section of the printing press 1 containing the feed cylinder 2 and the at least three impression cylinders 3, 4, 5. The second impression cylinder 4 is embodied as a cylinder that guides the sheets through more than 360°. The section further shows an ink application unit 22 containing a print head 8 and an endless ink transfer belt 9 guided by four rollers 10*a*, 10*b*. The lower two rollers 10*b* are pivotable in such a way that they move the ink transfer belt 9 into contact either with a sheet 6 on the first impression cylinder 3 or with a sheet 6 on the second impression cylinder 4. The ink transfer belt 9 is shown in a position for printing on a sheet 6 located on the first impression cylinder 3. A sheet 6 is shown as it passes through the printing process. The transfer belt 9 prints the first side of the sheet 6 as it is guided on the first impression cylinder 3. Then the sheet 6 is transferred to the second impression cylinder 4. On the second impression cylinder 4, the first side of the sheet 6, which has already been printed, faces inward.

Figure 2B:
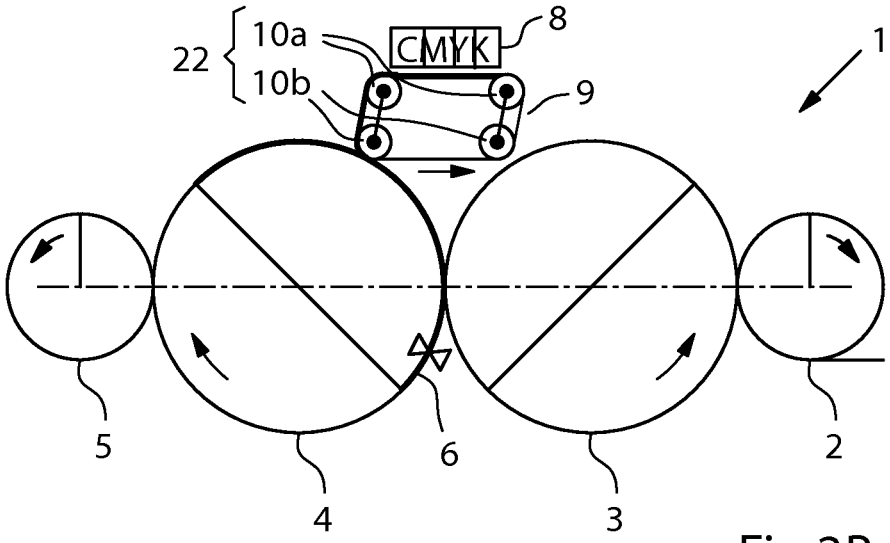

FIG. 2B illustrates the same section of the press 1 described in FIG. 2A. The second impression cylinder 4 carrying the sheet 6 has already carried out a revolution through more than 360°. The two lower rollers 10*b* of the ink application unit 22 have been pivoted in the direction of the second impression cylinder 4. The transfer belt 9 now prints the second side of the sheet 6. The direction of rotation of the belt 9 has been reversed.

Figure 2C:
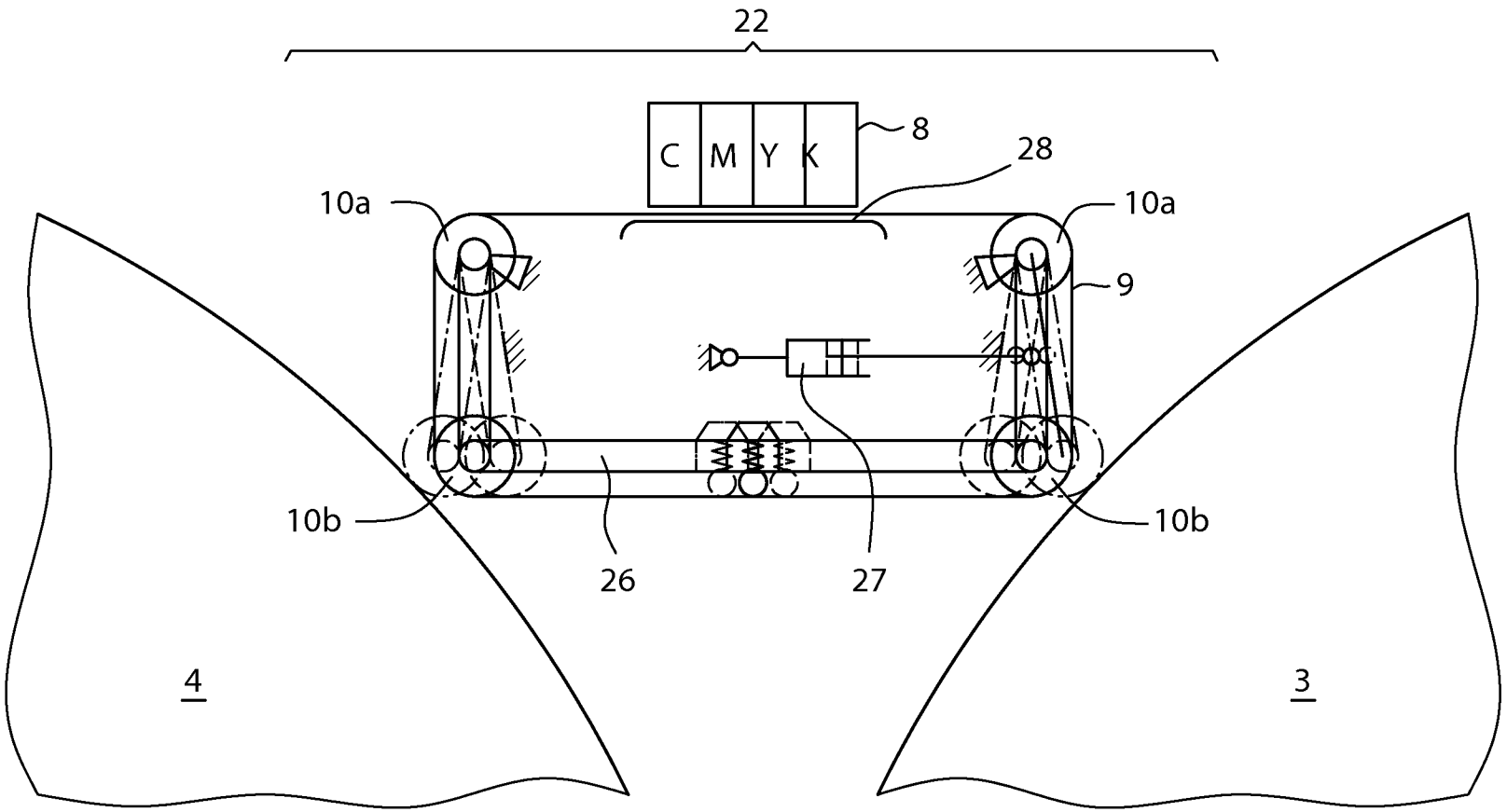

FIG. 2C illustrates a section of the arrangement described in FIG. 2A. What is shown is a print head 8 disposed above the ink transfer belt 9 guided by the four rollers 10*a*, 10*b* and a guide plate 28. An actuator 27 and a parallelogram guide 26 are provided to pivot the lower two rollers 10*b* in such a way that they move the ink transfer belt 9 into contact with a sheet 6 located on the first impression cylinder 3 or with a sheet 6 located on the second impression cylinder 4. The rollers 10*b* are in a neutral position.

Figure 3A:
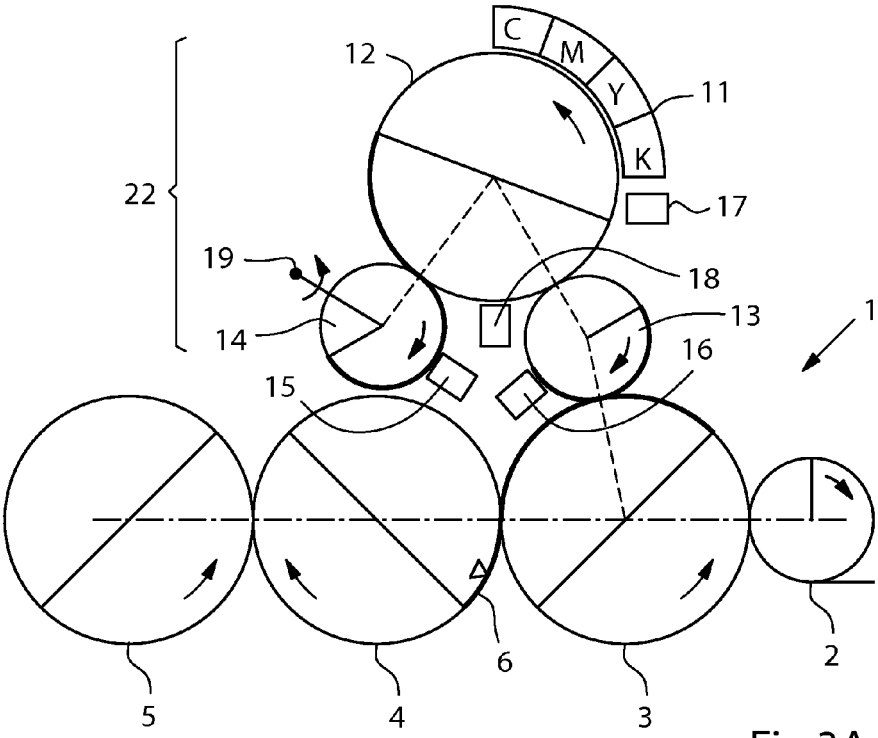
FIGS. 3A to 3C are diagrammatic side views of sections of a third embodiment of the printing press.

FIG. 3A illustrates a section of a printing press 1 containing the feed cylinder 2 and the at least three impression cylinders 3, 4, 5. The second impression cylinder 4 is embodied as a cylinder that guides the sheets 6 through more than 360°. The section further shows the ink application unit 22 having a print head 11, an imaging cylinder 12, a first transfer cylinder 13 with a washing device 16, and a second transfer cylinder 14 with a washing device 15 as well as two washing devices 17, 18 associated with the imaging cylinder. The second transfer cylinder 14 is configured to be capable of pivoting between the imaging cylinder 12 and the second impression cylinder 4. In addition, the second transfer cylinder 14 is capable of changing its direction or rotation as a function of whether it rolls on the imaging cylinder 12 or on the second impression cylinder 4. The figure further shows a sheet 6 that passes through the printing process. The first transfer cylinder 13 prints the first side of the sheet 6 as the sheet 6 is conveyed on the first impression cylinder 3. Then the sheet 6 is transferred to the second impression cylinder 4. On the second impression cylinder 4, the printed first side of the sheet 6 faces inward. During this process, the imaging cylinder 12 transfers the second-side image onto the second transfer cylinder 14 that has been pivoted in its direction. The two cylinders 12 and 14 are synchronized by a meshing engagement that may be established as needed.

Figure 3B:
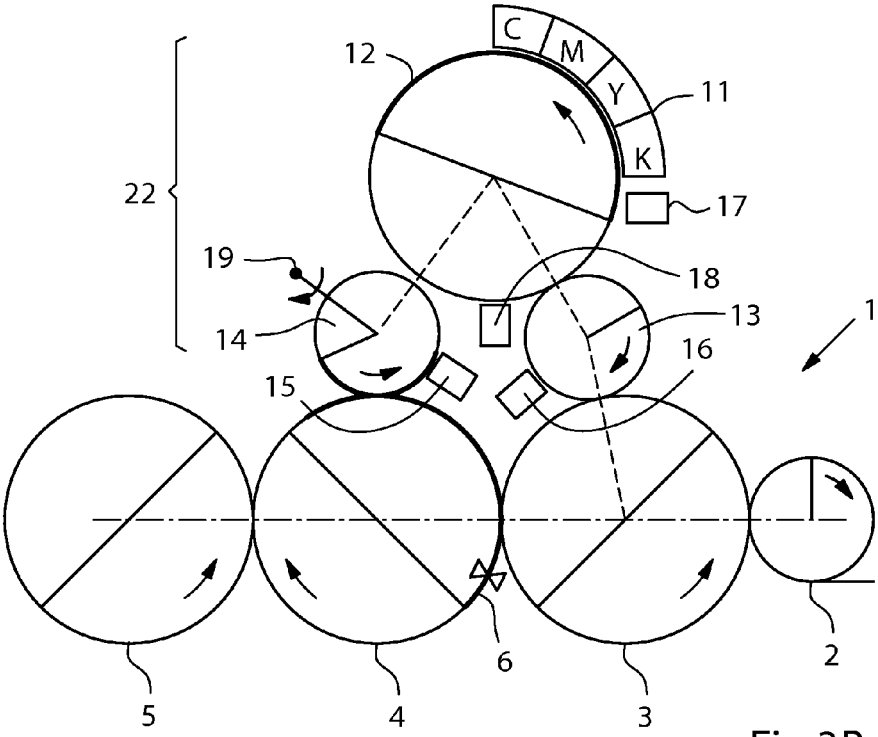

FIG. 3B illustrates the same section of the press 1 described in FIG. 3A. The second impression cylinder 4 carrying the sheet 6 has already carried out a revolution through more than 360°. The second transfer cylinder 14 has been pivoted in the direction of the second impression cylinder 4. The second transfer cylinder 14 now prints on the second side of the sheet 6. The two cylinders 14 and 4 are synchronized by a meshing engagement that may be established as needed.

Figure 3C:
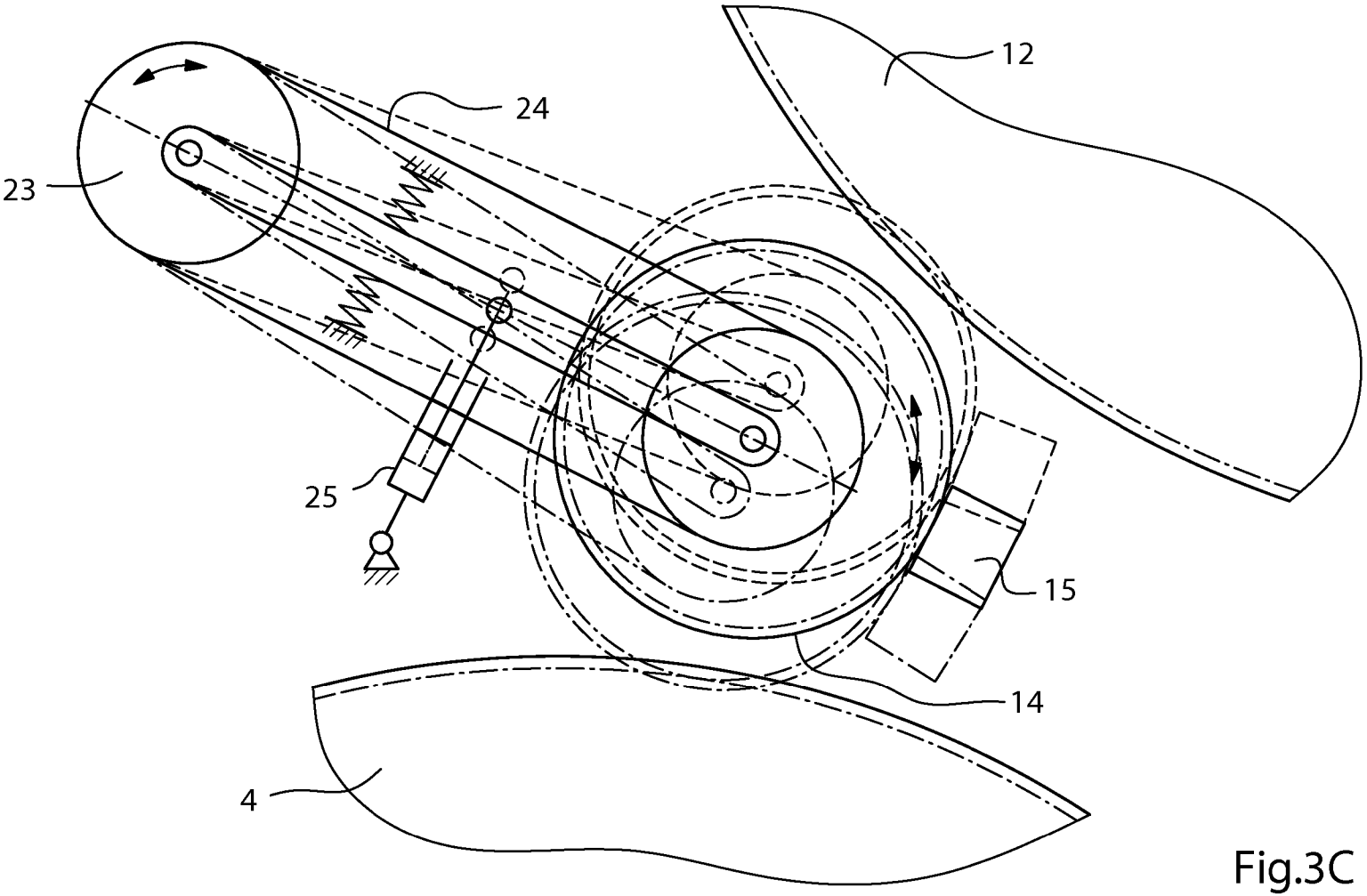

FIG. 3C illustrates a section of the arrangement described in FIG. 3A. What is shown is the pivotable transfer cylinder 14 with a washing device 15. The transfer cylinder 14 is driven by a motor 23 that is capable of changing the direction of rotation. An actuator 25 is provided to pivot the transfer cylinder between the imaging cylinder 12 and the second impression cylinder 4.

FIG. 1A, FIG. 1B, and FIG. 1C illustrate an embodiment of the invention containing pivotable inkjet print heads 7. The sheet 6 is transferred from the feed cylinder 2 to the first impression cylinder 3. On the first impression cylinder 3, the first side of the sheet 6 is printed by the first inkjet print head 7. In the process, the inkjet print head 7 rests against the end position damper 29*a*. The first impression cylinder 3 transfers the sheet 6 to the second impression cylinder 4, which receives the sheet 6 and guides it past a third impression cylinder 5 without transferring it. At the same time, the pneumatic pivoting device 31 pivots the inkjet print head 7 in the direction of the second-side printing position. The speed of impact on end position stop 29*b* is reduced by the end position damper 30*b* and the inkjet print head rests against the end position stop 29*b*. The second impression cylinder 4 guides the sheet 6 back into the effective region of the first inkjet print head 7, which has been pivoted. The first inkjet print head 7 then prints the second side of the sheet 6. Subsequently, the second impression cylinder 4 passes the sheet 6 on to the third impression cylinder 5.

FIG. 2A, FIG. 2B, and FIG. 2C illustrate an embodiment of the invention containing the ink application unit 22 that contains the print head 8 and the endless ink transfer belt 9 guided by the four rollers 10*a*, 10*b* and the guide plate 28. The print head 8 prints the image onto the transfer belt 9. The sheet 6 is transferred from a feed cylinder 2 to the first impression cylinder 3. The two lower rollers 10*b* are connected by the parallelogram guide 26 and are pivoted in the direction of the first impression cylinder 3 by the actuator 27, causing the transfer belt 9 to get into contact with the sheet 6. The transfer belt 9 prints the image onto the first side of the sheet 6. The sheet 6 is transferred from the first impression cylinder 3 to the second impression cylinder 4, which receives the sheet 6 and guides it past the third impression cylinder 5 without transferring it. At the same time, the actuator 27 pivots the two lower rollers 10*b* in the direction of the second impression cylinder 4. The second impression cylinder 4 again guides the sheet 6 into the effective region of the transfer belt 9, which has been pivoted and now prints the second side of the sheet 6. Then the second impression cylinder 4 transfers the sheet 6 to the third impression cylinder 5.

FIG. 3A, FIG. 3B and FIG. 3C illustrate an embodiment of the invention containing the ink application unit 22 containing the print head 11, the imaging cylinder 12, the first transfer cylinder 13 with the washing device 16, and a second transfer cylinder 14 with a washing device 15, as well as two washing devices 17, 18 associated with the imaging cylinder. The print head 11 prints the first-side image onto the imaging cylinder 12. The imaging cylinder 12 then transfers the image to the first transfer cylinder 13. Then the washing device 17 removes the first-side image from the imaging cylinder. At the same time, a sheet 6 is transferred from the feed cylinder 2 to the first impression cylinder 3. On the first impression cylinder 3, the first side of the sheet 6 is printed. Subsequently, the first impression cylinder 3 transfers the sheet 6 to the second impression cylinder 4. At the same time, the print head 11 prints the second-side image on the imaging cylinder 12. The second transfer cylinder 14 is driven by the motor 23 via a timing belt 24. The motor 23 is capable of reversing its direction of rotation. In the beginning, the transfer cylinder 14 is in a neutral position. The actuator 25 pivots the transfer cylinder 14 against the imaging cylinder 12. The transfer cylinder 14 rolls off on the imaging cylinder 12 and receives the second-side image. The second impression cylinder 4 guides the sheet 6 past the third impression cylinder 5. At the same time, the actuator 25 pivots the transfer cylinder 14 in the direction of the second impression cylinder 4. In this process, the motor 23 reverses the direction of rotation. Now the transfer cylinder 14 rolls off on the second impression cylinder 4, where it prints the second-side image onto the second side of the sheet 6. Then the second impression cylinder 4 transfers the sheet 6 to the third impression cylinder 5.

The following is a summary list of reference numerals and the corresponding structure used in the above description of the invention:

1 printing machine
2 feed cylinder
3 first impression cylinder
4 second impression cylinder
5 third impression cylinder
6 sheet
7*a* inkjet print head
7*b* inkjet print head
8 print head
9 ink transfer belt
10*a* stationary roller
10*b* pivotable roller
11 print head
12 imaging cylinder
13 first transfer cylinder
14 second transfer cylinder
15 washing device
16 washing device
17 washing device
18 washing device
19 pivoting device
22 ink transfer unit
23 motor
24 timing belt
25 actuator
26 parallelogram guide
27 actuator
28 guide plate
29*a* end stop
29*b* end stop
30*a* end stop damper
30*b* end stop damper
31 pneumatic moving device

The invention claimed is:

1. A device for printing on both sides of sheet-shaped printing substrates, the device comprising:

impression cylinders including a first impression cylinder and a second impression cylinder; and a pivotable ink application unit disposed to pivot between said first and second impression cylinders that succeed each other and to print on both sides of a same sheet, said ink application unit printing a first side of the substrates on said first impression cylinder and printing a second side of the substrates on said second impression cylinder with the first side facing inward on said second impression cylinder.

2. The device according to claim 1, wherein said pivotable ink application unit is an inkjet print head.

3. The device according to claim 2, further comprising end stops, a pivoting movement of said inkjet print head is limited by said end stops.

4. The device according to claim 3, wherein said end stops have dampers that are suitable for reducing a speed of impact of said inkjet print head on said end stops.

5. The device according to claim 2, wherein said pivotable ink application unit has at least three rollers and disposed above said impression cylinders and a transfer belt guided by said at least three rollers, said at least three rollers include upper two rollers being stationary and at least one lower roller being movable.

6. The device according to claim 5, further comprising a parallelogram guide having three movable elements defining three sides of a parallelogram and said at least one movable lower roller is one of at least two movable lower rollers which are movable via said three movable elements of said parallelogram guide.

7. The device according to claim 5, wherein a printed image is applied to said transfer belt by said inkjet print head.

8. The device according to claim 1, wherein:

said pivotable ink application unit has a print head, an imaging cylinder, a first transfer cylinder and a second transfer cylinder;

said print head prints on said imaging cylinder;

said imaging cylinder prints a first-side image onto said first transfer cylinder;

said first transfer cylinder transfers the first-side image to a first side of the sheet;

said imaging cylinder transfers a second-side image onto said second transfer cylinder;

said second transfer cylinder is capable of being pivoted between said imaging cylinder and a second of said impression cylinders; and said second transfer cylinder transfers the second-side image to a second side of the sheet.

9. The device according to claim 8, wherein said second transfer cylinder has a reversible rotation drive.

10. The device according to claim 1, wherein the sheet-shaped printing substrates are guided through more than 360° on said second impression cylinder.

11. A device for printing on both sides of sheet-shaped printing substrates, the device comprising:

impression cylinders; and a pivotable ink application unit disposed to pivot between two of said impression cylinders that succeed each other and to print on both sides of a same sheet;

the sheet-shaped printing substrates being guided through more than 360° on a second impression cylinder of two successive ones of said impression cylinders.

* * * * *